US011358815B2

(12) United States Patent
Takigawa

(10) Patent No.: US 11,358,815 B2
(45) Date of Patent: Jun. 14, 2022

(54) SHEET FEEDING DEVICE AND CONTROL METHOD THEREFOR

(71) Applicant: KYOCERA Document Solutions Inc., Osaka (JP)

(72) Inventor: Junichi Takigawa, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 47 days.

(21) Appl. No.: 16/931,403

(22) Filed: Jul. 16, 2020

(65) Prior Publication Data

US 2021/0024307 A1 Jan. 28, 2021

(30) Foreign Application Priority Data

Jul. 22, 2019 (JP) ..... JP2019-134372

(51) Int. Cl.

| | |
|---|---|
| ***B65H 1/14*** | (2006.01) |
| ***B65H 1/26*** | (2006.01) |
| ***B65H 1/18*** | (2006.01) |
| ***B65H 7/02*** | (2006.01) |

(52) U.S. Cl.

CPC ..... *B65H 1/14* (2013.01); *B65H 1/18* (2013.01); *B65H 1/266* (2013.01); *B65H 7/02* (2013.01); *B65H 2511/152* (2013.01); *B65H 2511/22* (2013.01)

(58) Field of Classification Search

CPC ... B65H 1/04; B65H 1/08; B65H 1/14; B65H 7/00; B65H 7/02; B65H 7/18; B65H 2511/15; B65H 2511/152; B65H 2511/22

See application file for complete search history.

(56) References Cited

U.S. PATENT DOCUMENTS

| | | | | |
|---|---|---|---|---|
| 6,095,512 | A * | 8/2000 | Vijuk | B65H 43/00 493/416 |
| 2002/0135628 | A1* | 9/2002 | Kolodziej | G03G 15/553 358/1.15 |
| 2016/0289014 | A1* | 10/2016 | Aizono | B65H 7/04 |
| 2020/0385223 | A1* | 12/2020 | Witkoe | B65H 1/12 |

FOREIGN PATENT DOCUMENTS

| | | | |
|---|---|---|---|
| JP | 2008-013357 | A | 1/2008 |

* cited by examiner

*Primary Examiner* — Prasad V Gokhale
(74) *Attorney, Agent, or Firm* — Stein IP, LLC

(57) ABSTRACT

Sheets are set on the top face of a lift plate. A lift mechanism makes a lift plate ascend and descend. A sheet feeding roller and a distance sensor are provided over the lift plate. The distance sensor measures a distance (measured distance) to a measurement target placed below. Based on the measured distance before the lift plate is raised, the controller calculates a remaining quantity value indicating a remaining quantity of sheets. When, after the lift plate starts to rise, the recognized measured distance becomes equal to or smaller than the upper limit distance, the controller makes the lift mechanism stop raising the lift plate.

13 Claims, 7 Drawing Sheets

SHEET FEEDING DEVICE AND CONTROL METHOD THEREFOR

INCORPORATION BY REFERENCE

This application is based upon and claims the benefit of priority from the corresponding Japanese Patent Application No. 2019-134372 filed on Jul. 22, 2019, the entire contents of which are incorporated herein by reference.

BACKGROUND

The present disclosure relates to a sheet feeding device which stores sheets and feeds them out during printing.

There are image forming apparatuses such as multifunction peripherals and printers. Some image forming apparatuses include a sheet cassette. A bundle of sheets is stored in the sheet cassette. During printing, sheets are fed out from the sheet cassette. In order to feed out sheets appropriately, a plurality of sensors are provided in the sheet cassette.

One known example of a sheet feeding device including a plurality of sensors is as follows. Specifically, disclosed is a sheet feeding device which includes: an upper limit position detection sensor which raises and lowers a sheet storing portion for storing sheets stacked on it, feeds out sheets from a predetermined sheet feeding position in the sheet storing portion, is arranged around the top of the ascending and descending path in the sheet storing portion, and senses the sheet storing portion reaching the upper limit position; a lower limit position detection sensor which is arranged around the bottom of the ascending and descending path and senses the sheet storing portion reaching the lower limit position; and a remaining quantity detection sensor which is arranged around the middle of the ascending and descending path and detects the remaining quantity of sheets. The remaining quantity detection sensor also has a function of detecting an abnormality in raising and lowering movement of the sheet storing portion.

Sheets are set in the sheet cassette. When sheets run out, a user pulls out the sheet cassette, supplies new sheets, and then puts the sheet cassette back in. A sheet feeding roller is often provided over the set bundle of sheets. In this case, a sheet setting plate on which a bundle of sheets is set can be raised and lowered. The sheet setting plate is lifted up and the topmost sheet makes contact with the sheet feeding roller. The sheet setting plate is lifted up, for example, after the sheet cassette is opened and closed. For the detection of whether the sheet cassette is open or closed, there is provided a sensor for detecting the sheet cassette being open or closed. For the detection of whether the sheet setting plate has been lifted up sufficiently (up to the upper limit), an upper limit detection sensor is provided.

Some image forming apparatuses display on the display panel the current remaining level of sheets. For the sensing of the remaining level of sheets, the remaining quantity sensor is provided. A size detection sensor for detecting the size of the sheets set in the sheet cassette is often provided in the sheet cassette.

In this way, a plurality of sensors are provided in the sheet cassette. Inconveniently, as the number of sensors increases, the manufacturing cost increases and the manufacturing (assembling) difficulty increases.

The known apparatus mentioned above requires a sensor for upper limit detection, a sensor for lower limit detection, and a sensor for remaining quantity detection. Three sensors are provided in a single sheet cassette. This can lead to a high manufacturing cost and complicated manufacturing steps.

SUMMARY

According to one aspect of the present disclosure, a sheet feeding device includes a sheet cassette, a lift plate, a lift mechanism, a sheet feeding roller, a distance sensor, and a controller. The lift plate is provided inside the sheet cassette. On top of the lift plate, sheets are set. The lift mechanism makes the lift plate ascend and descend. The sheet feeding roller is provided over the lift plate. The sheet feeding roller makes contact with sheets lifted up by the lift mechanism. The sheet feeding roller rotates and feeds out sheets. The distance sensor is provided over the lift plate. The distance sensor measures a measured distance, which is the distance to a measurement target below. Based on the output of the distance sensor, the controller recognizes the measured distance. After the sheet cassette is opened and closed, the controller calculates a remaining quantity value indicating the remaining quantity of sheets based on the measured distance recognized before the lift plate is raised. When, after the lift plate starts to rise, the recognized measured distance becomes equal to or smaller than the upper limit distance prescribed as the measured distance when the lift plate is at an upper limit position, the controller makes the lift mechanism stop raising the lift plate.

This and other objects of the present disclosure, and the specific benefits obtained according to the present disclosure, will become apparent from the description of embodiments which follows.

DETAILED DESCRIPTION

The present disclosure is aimed at reducing the manufacturing cost and simplifying the manufacturing steps by sensing a plurality of items with a single sensor and thereby reducing the number of installed sensors. Hereinafter, with reference to FIGS. 1 to 11, an embodiment of the present disclosure will be described. As an example of a sheet feeding device, a printer 100 will be taken in the following description. The printer 100 is also an image forming apparatus. The sheet feeding device is not limited to a printer 100. The sheet feeding device may be an image forming apparatus of any other type, such as a multifunction peripheral. All the features described in connection with the embodiment in terms of structures, arrangements, and the like are merely examples and are not meant to limit the scope of the disclosure.

(Printer 100)

Figure 1:
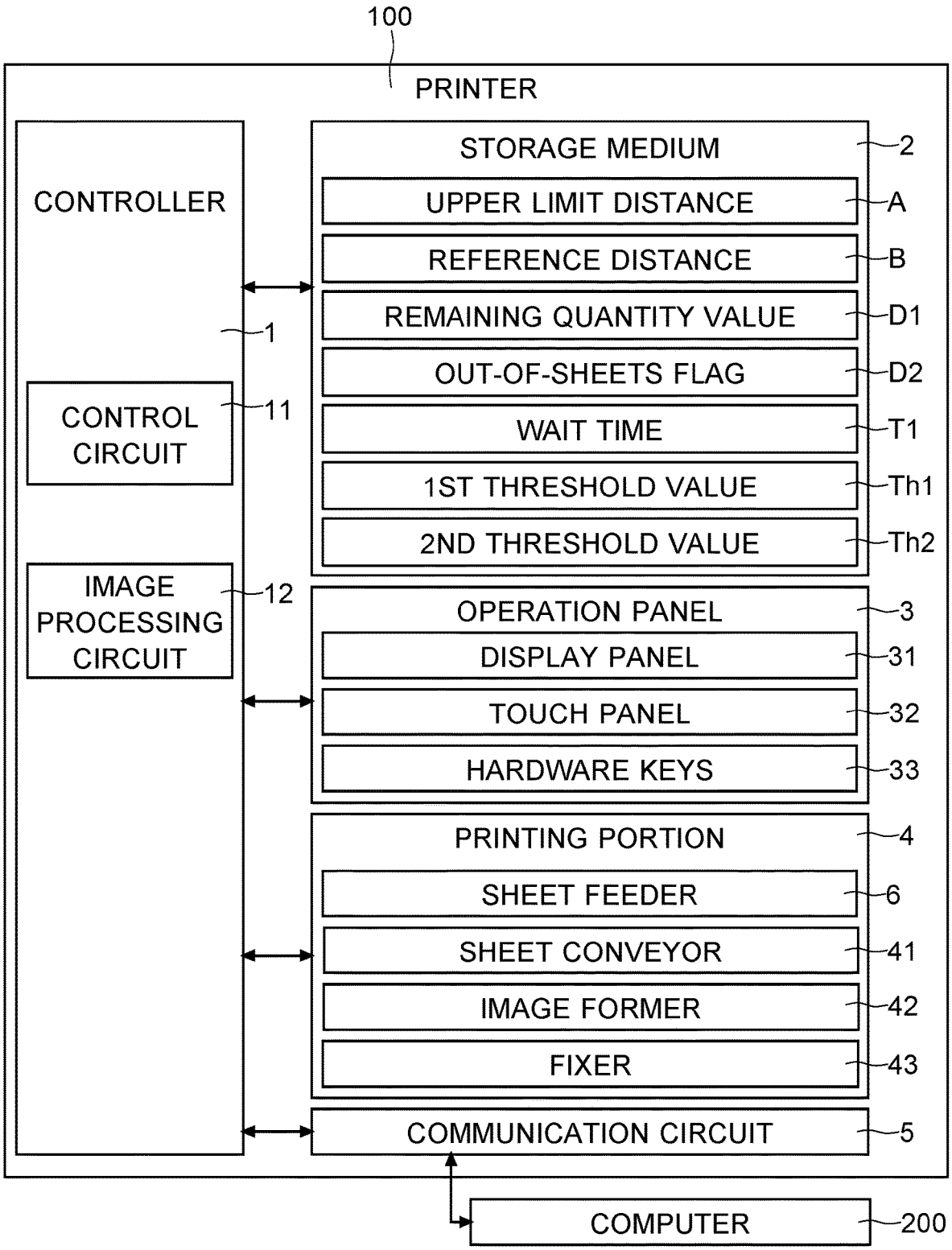
FIG. 1 is a diagram showing one example of a printer according to an embodiment.

With reference to FIG. 1, one example of the printer 100 according to an embodiment will be described. The printer 100 includes a controller 1, a storage medium 2, an operation panel 3, a printing portion 4, and a communication circuit 5.

The controller 1 controls operation of the printer 100. The controller 1 includes a control circuit 11 and an image processing circuit 12. The control circuit 11 is, for example, a CPU. The image processing circuit 12 is an integrated circuit for image processing (for example, an ASIC). The control circuit 11 controls, based on programs and data stored in the storage medium 2, different parts (the operation panel 3, the printing portion 4, and the communication circuit 5). The image processing circuit 12 performs various kinds of image processing.

The printer 100, as a storage medium 2, includes a ROM, a storage, and a RAM. The ROM is, for example, a flash ROM. The storage is a large non-volatile storage device such as an HDD or an SSD. The storage medium 2 stores various kinds of data and control programs. For example, the storage medium 2 stores control data, setting data, and image data.

The operation panel 3 includes a display panel 31, a touch panel 32, and hardware keys 33. The display panel 31 displays a screen and an image. The controller 1 (control circuit 11) controls display on the display panel 31. The controller 1 makes the display panel 31 display operation images used for setting of a job. The operation images include, for example, buttons, keys, and tabs. The touch panel 32 accepts user operation. The touch panel 32 is provided on the top face of the display panel 31. The touch panel 32 recognizes the touched position. Based on the output from the touch panel 32, the controller 1 recognizes the operated operation image. Based on the operated operation image, the controller 1 recognizes user operation. Hardware keys 33 also accept user operation.

The printer 100 includes a printing portion 4. The printing portion 4 includes a sheet feeder 6, a sheet conveyor 41, an image former 42, and a fixer 43. The sheet feeder 6 will be described in detail later. The sheet conveyor 41 includes, for example, a motor and a conveying roller pair. The controller 1 makes the sheet conveyor 41 convey the sheet fed out from the sheet feeder 6. The image former 42 includes, for example, a photosensitive drum, a charging device, an exposure device, a developing device, and a transfer roller. The controller 1 operates such that a photosensitive drum is electrostatically charged and is exposed based on image data. The controller 1 has an electrostatic latent image on the photosensitive drum developed with toner. The controller 1 operates such that a toner image is transferred to a sheet. The fixer 43 includes, for example, a heater and a fixing roller. The controller 1 makes the fixer 43 heat and press the sheet to which the toner image has been transferred. The controller 1 makes the fixer 43 fix the toner image.

The controller 1 includes a communication circuit 5. The communication circuit 5 includes a communication circuit and a communication memory. The communication memory stores communication software. The communication circuit 5 (a circuit for communication) can communicate with a computer 200 via a network. The computer 200 is, for example, a PC or a server. The communication circuit 5 receives printing data from the computer 200.

The print data includes, for example, data written in a page description language. The controller 1 (the image processing circuit 12) analyzes data written in a page description language to generate image data based on the description with the page description language (rasterization processing). The controller 1 (image processing circuit 12) further performs image processing on generated image data to generate output image data. Based on output image data, the controller 1 makes the printing portion 4 perform printing. For example, the exposure device of the image former 42 makes a photosensitive drum exposed based on output image data.

(Sheet Feeder 6)

Next, with reference to FIGS. 2 to 5, the sheet feeder 6 according to the embodiment will be described. The sheet feeder 6 stores sheets to feed them out one after another. A plurality of sheet feeders 6 can be stacked over each other. The sheet feeder 6 includes a sheet cassette 7. The sheet cassette 7 stores sheets. The sheet cassette 7 can be opened and closed. The sheet cassette 7 can be drawn out of and removed from the printer 100. For sheet replenishment, the sheet cassette 7 is opened and drawn out. Also when the sheet size is changed, the sheet cassette 7 is drawn out. The direction in which the sheet cassette 7 is opened (drawn out) is the direction toward the front of the printer 100 (see FIG. 2). When the sheet cassette 7 is closed (fitted), a user pushes the sheet cassette 7 in the direction toward the rear of the printer 100 (see FIG. 2).

The sheet cassette 7 includes a lift plate 71, two width regulation cursors 72, and a rear end regulation cursor 73. The lift plate 71 is provided inside the sheet cassette 7. Sheets (a bundle of sheets) are set on the lift plate 71. An upstream-side end part (a right-side end part in FIG. 2) of the lift plate 71 in the sheet conveying direction is pivotably supported by a supporting portion 74.

The lift plate 71 is pivotable in the up-down direction. A downstream-side end part (a left-side end part in FIG. 2) of the lift plate 71 in the sheet conveying direction is a free end. The downstream-side end part of the lift plate 71 is raised and lowered. A lift mechanism 75 makes the lift plate 71 ascend and descend. The lift mechanism 75 is provided under the lift plate 71. The lift mechanism 75 includes a lift motor 76, a shaft 77, a push-up plate 78, and a joint member 79.

The lift motor 76 is provided outside the sheet cassette 7 (on the main body side). The longitudinal direction of the shaft 77 is a direction perpendicular to the sheet conveying direction. The shaft 77 is coupled to the lift motor 76 via the joint member 79 (see FIG. 5). The push-up plate 78 is fitted to the shaft 77. The joint member 79 transmits a driving force to the shaft 77. The shaft 77 rotates by being driven by the lift motor 76. The controller 1 operates the lift motor 76 to rotate the shaft 77. This makes the push-up plate 78 pivot. When the push-up plate 78 pivots, the lift plate 71 (downstream-side end part) ascends (is lifted up). During printing, the controller 1 makes the lift plate 71 ascend until sheets make contact with the sheet feeding roller 61.

When the sheet cassette 7 is pulled out, the joint member 79 and the shaft 77 decouple from each other. When the sheet cassette 7 is opened (decoupled), the lift plate 71 descends automatically by the action of gravity (under its own weight). The lift mechanism 75 makes the lift plate 71 descend under gravity. Eventually, the lift plate 71 and the push-up plate 78 descend down to their lower limit positions. The lift plate 71 and the push-up plate 78 lie flat.

The joint member 79 rotates the shaft 77 only in such a direction as to raise the lift plate 71. The structure is such that, with the joint member 79 and the shaft 77 coupled together, lift plate 71 does not lower under its own weight. The joint member 79 includes, for example, a ratchet mechanism. Unless the sheet cassette 7 is drawn out (opened), the lift mechanism 75 maintains the height of the lift plate 71.

When the sheet cassette 7 is fitted, the shaft 77 is inserted in the joint member 79. In other words, the joint member 79 and the shaft 77 are coupled together. When the sheet cassette 7 is opened and closed (removed and fitted), the controller 1 drives the lift motor 76 before sheet feeding is started. The controller 1 makes the lift plate 71 ascend up to the upper limit. The controller 1 makes the lift motor 76 rotate momentarily every time one sheet is or a plurality of sheets are fed. The controller 1 makes the lift plate 71 ascend such that the topmost sheet is always in contact with the sheet feeding roller 61.

The sheet feeder 6 includes a sheet feeding mechanism. The sheet feeding mechanism includes a sheet feeding roller 61, a separating roller pair 62 (a feed roller and a retard roller), and a sheet feeding motor 60. The sheet feeding roller 61 is provided over a downstream-side end part of the lift plate 71. The sheet feeding roller 61 makes contact with a sheet that is lifted up by the lift mechanism 75. The sheet feeding roller 61 rotates and feeds out a sheet that is in contact with it. The separating roller pair 62 is provided on the downstream side of the sheet feeding roller 61 in the conveying direction. The separating roller pair 62 prevents double feeding of sheets. The upper feed roller of the separating roller pair 62 rotates in such a direction (forward direction) as to feed a sheet to a sheet conveyor 41 (conveying passage). The lower retard roller rotates in such a direction (reverse direction) as to send a sheet to the sheet cassette 7. For the retard roller, a torque limiter is used. When double feeding of sheets is occurring, the retard roller feeds the lower sheet backward. When double feeding of sheets is not occurring, the lower roller rotates forward.

The sheet feeding motor 60 makes the sheet feeding roller 61 and the separating roller pair 62 rotate. During a printing job, the controller 1 makes the sheet feeding motor 60 rotate to feed a sheet to the sheet feeder 6. The sheet fed out from the sheet feeder 6 is fed into the sheet conveyor 41. The controller 1 makes the sheet conveyor 41 convey the sheet fed out from the sheet feeder 6.

The rotary shaft of the sheet feeding roller 61 is supported on a supporting shaft member 63. The supporting shaft member 63 is laid on the rotary shaft of the separating roller pair 62 (feed roller). The supporting shaft member 63 swings in the up-down direction. With the supporting shaft member 63, the sheet feeding roller 61 can swing in the up-down direction.

When the lift motor 76 is rotated to raise the lift plate 71, the sheet feeding roller 61 and the topmost sheet eventually makes contact with each other. When the lift plate 71 is raised further, the sheet feeding roller 61 is lifted up together. That is, the lift plate 71 lifts a bundle of sheets and the sheet feeding roller 61. The sheet feeding roller 61 does not ascend beyond a given limit. When the sheet feeding roller 61 reaches the upper limit, also the lift plate 71 reaches the upper limit. When the sheet feeding roller 61 and the lift plate 71 are recognized to have reached the upper limit, the controller 1 stops the lift motor 76. The position (height) of the lift plate 71 at the upper limit varies depending on the thickness of the bundle of sheets that is set.

Figure 3:
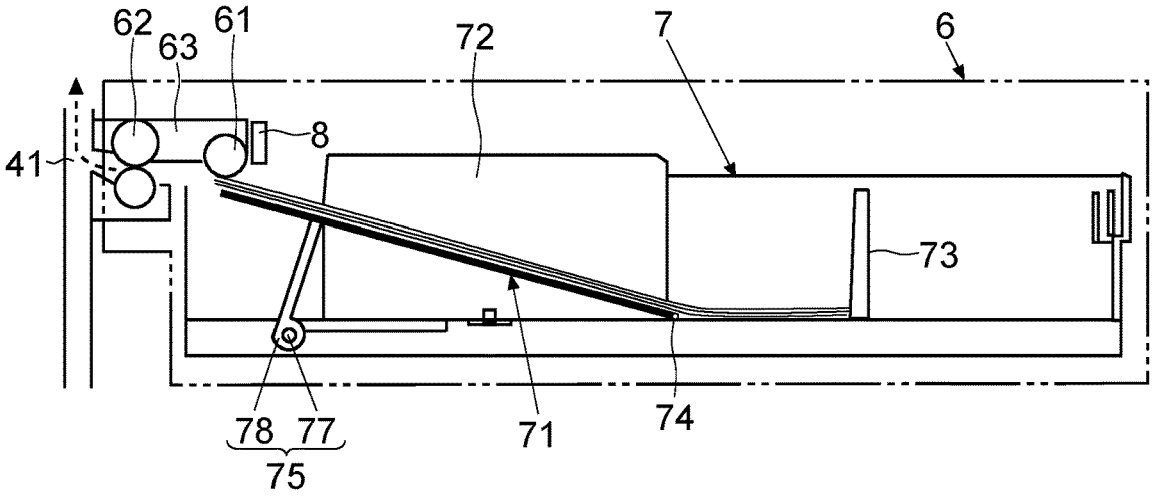
FIG. 3 is a diagram showing the one example of the sheet feeder according to the embodiment.
Figure 4:
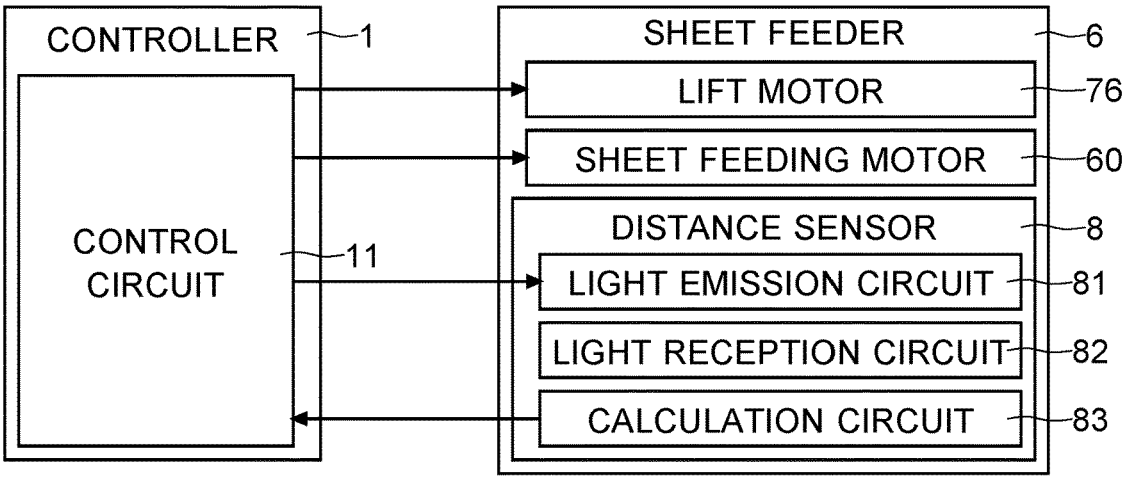
FIG. 4 is a diagram showing the one example of the sheet feeder according to the embodiment.
Figure 5:
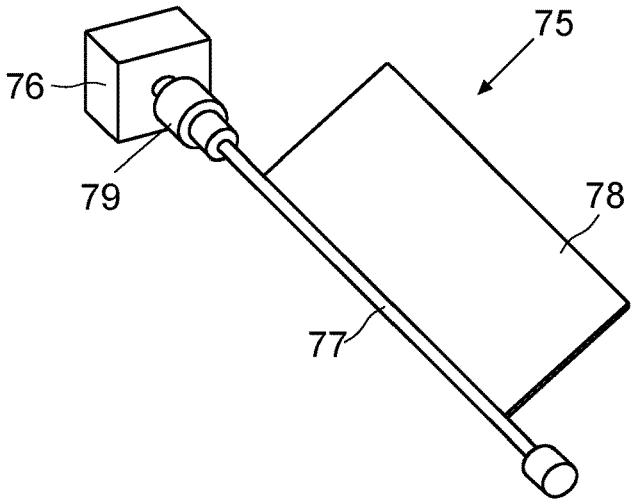
FIG. 5 is a diagram showing the one example of the sheet feeder according to the embodiment.

As shown in FIGS. 3 and 4, the sheet feeder 6 includes a distance sensor 8. The distance sensor 8 is provided over the lift plate 71. The distance sensor 8 is provided near the sheet feeding roller 61. The distance sensor 8 is provided upstream of the sheet feeding roller 61 in the sheet conveying direction (sheet feeding direction). The distance sensor 8 is a sensor for measuring the distance to a measurement target placed below.

The distance sensor 8 includes a light emission circuit 81, a light reception circuit 82, and a calculation circuit 83. The light emission circuit 81 emits (radiates) a laser beam. The distance sensor 8 emits a laser beam in the direction where the lift plate 71 and the sheet are. The distance sensor 8 (light emission circuit 81) emits the laser beam, for example, vertically downward. The light reception circuit 82 receives the reflected laser beam. The calculation circuit 83 in the distance sensor 8 measures the time difference after the light emission circuit 81 starts to emit the laser beam until the light reception circuit 82 receives the laser beam reflected from the measurement target. The calculation circuit 83 converts the time difference to a distance. The distance sensor 8 may be a sensor that measures a distance using infrared light. The distance sensor 8 may be a sensor that measures a distance using ultrasonic wave.

The distance sensor 8 and the controller 1 are communicably connected together. The calculation circuit 83 in the distance sensor 8 notifies the controller 1 (control circuit 11) of the measured distance. Based on the output of the distance sensor 8, the controller 1 recognizes the distance (measured distance) measured by the distance sensor 8. The distance measured by the distance sensor 8 varies based on the presence or absence of sheets, the remaining quantity of sheets, and the height of the lift plate 71. Based on the distance measured by the distance sensor 8, the controller 1 senses a plurality of items. The controller 1, with only the output of a single distance sensor 8, recognizes the remaining quantity of sheets, whether the lift plate 71 has reached the upper limit, whether sheets have run out, and whether the sheet cassette is open or closed.

(Distance Measured by the Distance Sensor 8)

Figure 6:
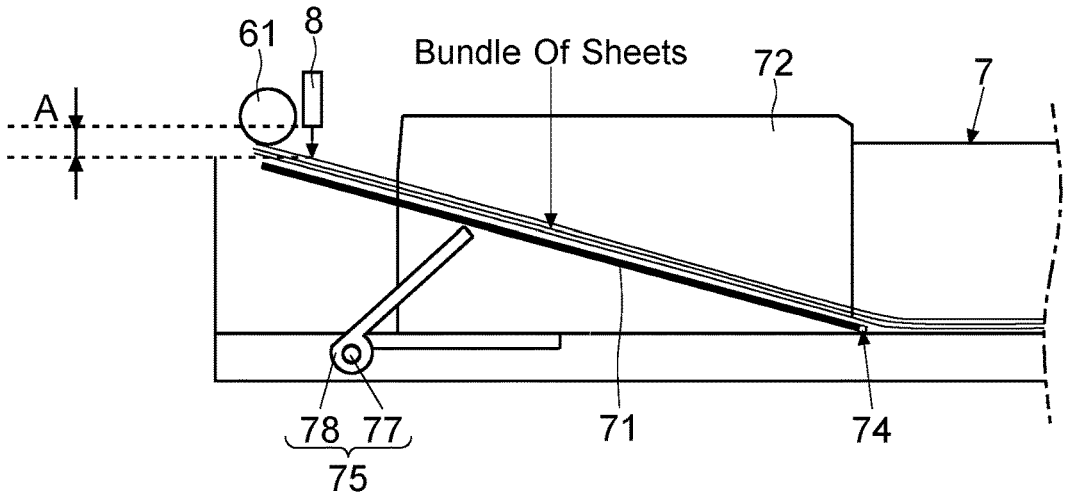
FIG. 6 is a diagram showing one example of the distance measured by a distance sensor according to the embodiment.

Next, with reference to FIGS. 6 and 8, an example of the distance measurement by the distance sensor 8 according to the embodiment will be described. FIG. 6 is a diagram showing one example of a state where the lift plate 71 with sheets set on it is raised up to the upper limit. In FIG. 6, sheets are set on the lift plate 71. When sheets have not yet run out but the lift plate 71 is raised up to the upper limit, the distance measured by the distance sensor 8 is the distance from the distance sensor 8 to the topmost sheet.

The position (height) of the topmost sheet when the lift plate 71 is raised up to the upper limit is constant regardless of the thickness of a bundle of sheets. When the lift plate 71 is at the upper limit position, the measurement target (a sheet) is closest to the distance sensor 8. The distance (upper limit distance A) from the distance sensor 8 to the topmost sheet when the lift plate 71 is raised up to the upper limit is the smallest that the distance sensor 8 ever measures.

The upper limit distance A is prescribed. When, for example, the lift plate 71 and the sheet feeding roller 61 reach the upper limit and the lift plate 71 ceases to move (after the lift motor 76 is locked), the controller 1 stops the lift motor 76. After the lift motor 76 is stopped, the actually measured distance from the distance sensor 8 (lower end) to the topmost sheet can be taken as the upper limit distance A. The storage medium 2 stores the upper limit distance A in a non-volatile manner (see FIG. 1).

After the lift plate 71 starts to rise, based on the output of the distance sensor 8, the controller 1 recognizes the measured distance. When the measured distance becomes equal to or smaller than the upper limit distance A, the controller 1 recognizes that the lift plate 71 has reached the upper limit. Here, the controller 1 makes the lift mechanism 75 stop raising the lift plate 71. Based on the distance sensor 8 and the upper limit distance A, it is possible to stop the lift plate 71 in a state where the topmost sheet is pressed against the sheet feeding roller 61 with a sufficient pressure.

Figure 7:
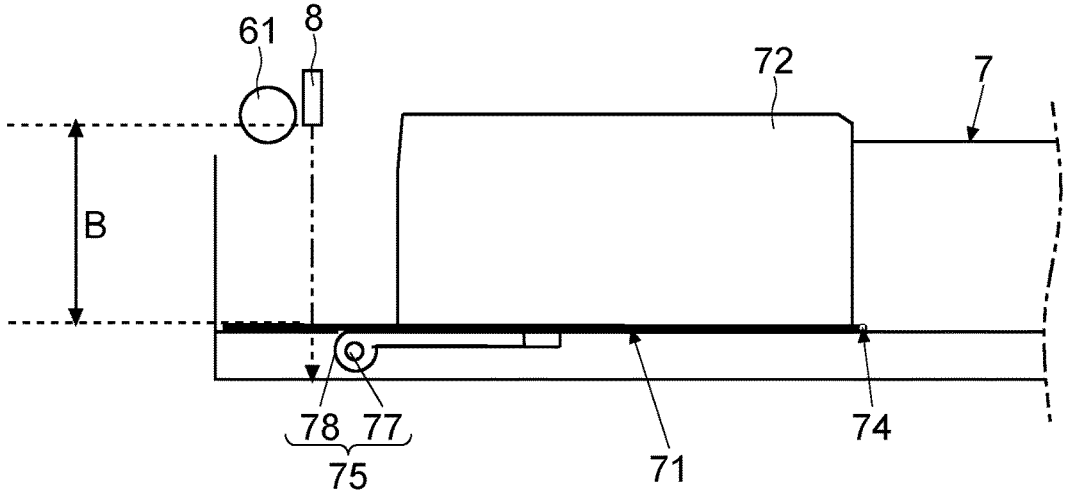
FIG. 7 is a diagram showing one example of the distance measured by the distance sensor according to the embodiment.

FIG. 7 is a diagram showing one example of a state where the lift plate 71 is at the lower limit position. When the sheet 7 is opened or closed, the lift plate 71 is at the lower limit position. FIG. 7 also shows one example of a state where sheets have run out. There is no sheet on the top face of the lift plate 71.

Figure 2:
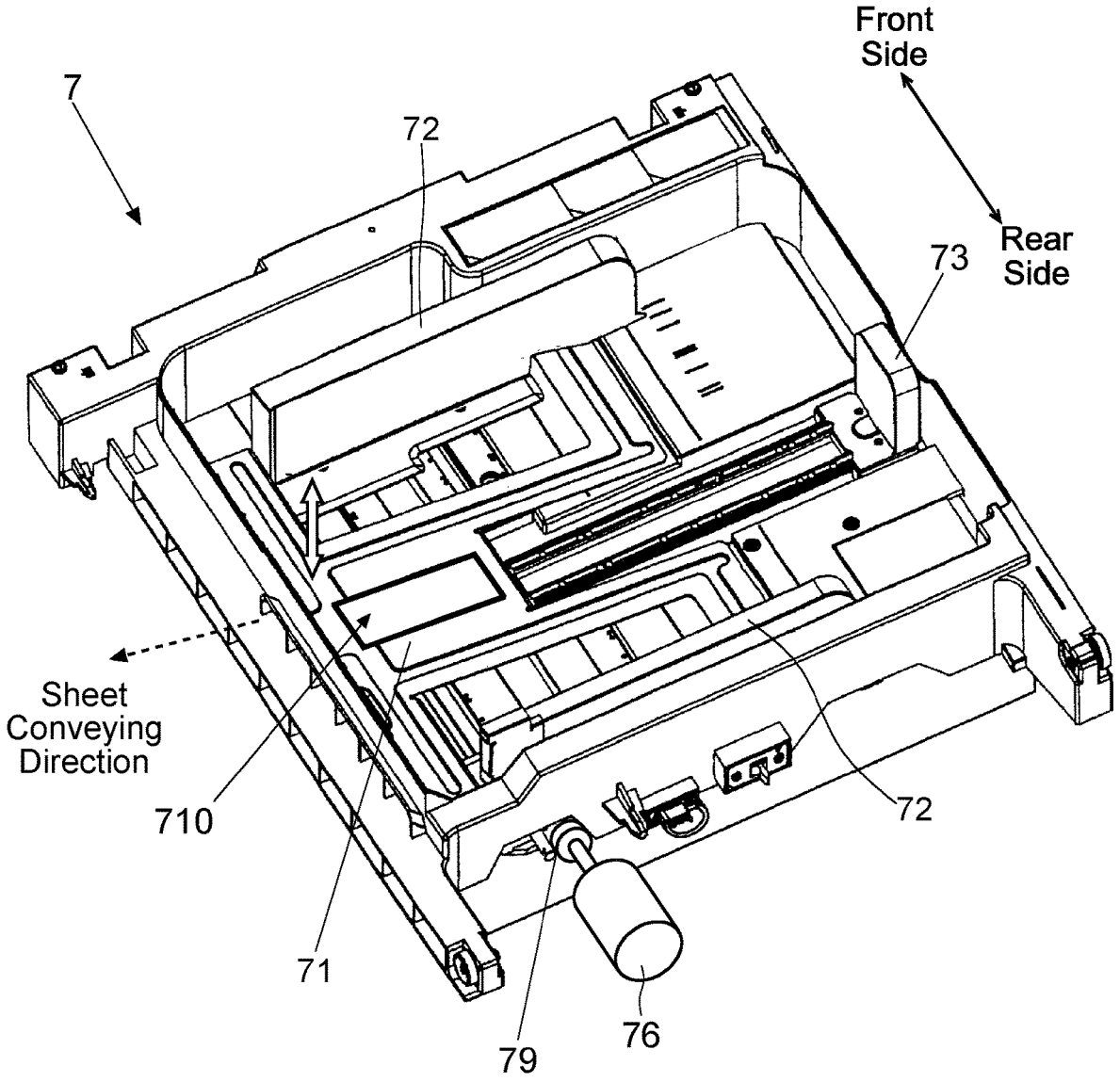
FIG. 2 is a diagram showing one example of a sheet feeder according to the embodiment.

Here, the lift plate 71 has a hole 710 formed in the detection range of the distance sensor 8 (the range irradiated with the laser beam) (see FIG. 2). When sheets have run out, the laser beam passes through the hole 710. The lift plate 71 does not reflect the laser beam. When sheets have run out and the sheet cassette 7 is fitted, regardless of the height of the lift plate 71, the laser beam is reflected on the bottom face of the sheet cassette 7.

A reference distance B is prescribed. The storage medium 2 stores the reference distance B in a non-volatile manner (see FIG. 1). The reference distance B is prescribed based on the distance from the distance sensor 8 to the lift plate 71 at the lower limit position. When sheets have run out, the measured distance is larger than the reference distance B. The reference distance B is the distance from the distance sensor 8 to the top face of the lift plate 71 at the lower limit position (when laid flat). Strictly speaking, due to the hole 710, the top face of the lift plate 71 is not in the detection range of the distance sensor 8. The reference distance B is the distance, assuming that there is no hole 710, from the lower end of the distance sensor 8 to the top face of the lift plate 71 at the lower limit position.

The distance measured by the distance sensor 8 when sheets have run out is the largest that the distance sensor 8 ever measures while the cassette is fitted. When sheets have run out, the measured distance is necessarily larger than the reference distance B. Thus, when the measured distance exceeds the reference distance B, the controller 1 recognizes that sheets have run out.

Figure 8:
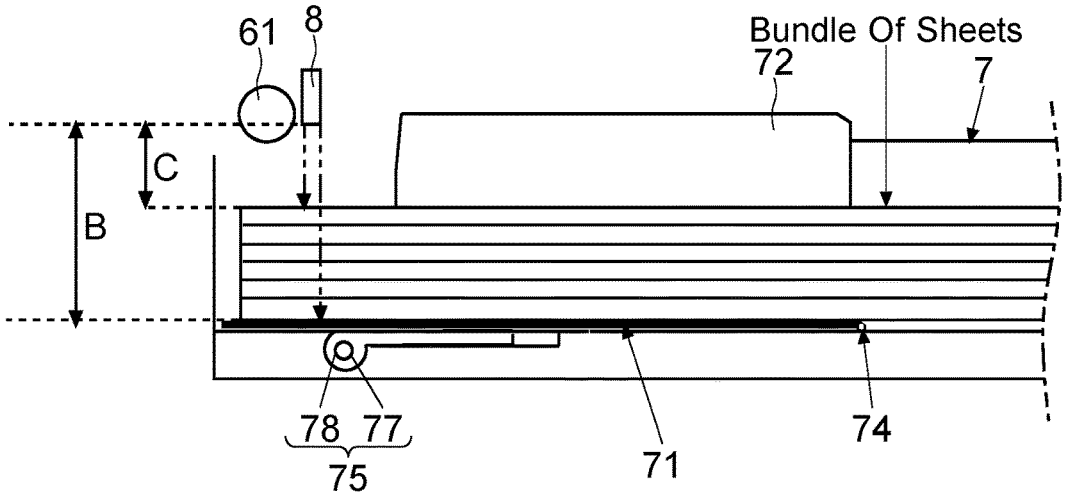
FIG. 8 is a diagram showing one example of the distance measured by the distance sensor according to the embodiment.

FIG. 8 is a diagram showing one example of a state of the lift plate 71 after the sheet cassette 7 is opened and closed before the lift plate 71 rises. FIG. 8 shows one example of a state where the lift plate 71 and the push-up plate 78 are at the lower limit position. FIG. 8 shows a state where sheets are set. In other words, FIG. 8 shows one example of a state where, after the sheet cassette 7 is removed, the sheet cassette 7 replenished with sheets is fitted back.

The controller 1, based on the reference distance B and the distance recognized before the lift plate 71 rises (a remaining quantity checking distance C), calculates a remaining quantity value D1. The remaining quantity value D1 is a value indicating the remaining quantity of sheets. When sheets are set, the distance measured by the distance sensor 8 before the lift plate 71 rises is equal to or larger than the upper limit distance A but smaller than the reference distance B. The closer to the upper limit distance A the measured distance is, the larger the amount of the set sheets is. The closer to the reference distance B the measured distance is, the smaller the amount of the set sheets is. Based on Formula (1) below, the controller 1 calculates the remaining quantity value D1.

$$\text{Remaining Quantity Value } D1 = \text{Reference Distance } B - \text{Measured Distance} \quad (1)$$

Measured Distance in formula (1) is the measured distance when the lift plate 71 is at the lower limit position. As will be seen from formula (1), the remaining quantity value D1 represents the thickness of the bundle of sheets that is set. The controller 1 makes the storage medium 2 store the calculated remaining quantity value D1 in a non-volatile manner.

The controller 1 can calculate a remaining quantity ratio. The remaining quantity ratio shows the ratio, to the thickness of a bundle of sheets at full load, of the current thickness of the bundle of sheets. The remaining quantity ratio at full load is assumed to be 100%. The remaining quantity ratio can be calculated by formula (2) below.

$$\text{Remaining Quantity Ratio} = ((\text{Reference Distance } B - \text{Upper Limit Distance } A) - (\text{Measured Distance} - \text{Upper Limit Distance } A)/(\text{Reference Distance } B - \text{Upper Limit Distance } A) \quad (2)$$

Formula (2) can be simplified as follows.

$$\text{Remaining Quantity Ratio} = \text{Reference Distance } B - \text{Measured Distance}/(\text{Reference Distance } B - \text{Upper Limit Distance } A)$$

Here, (Reference Distance B−Upper Limit Distance A) is a constant. Let the constant be C1; then it is possible to calculate the remaining quantity ratio by Remaining Quantity Value D1/C1. The controller 1 performs calculation to find the remaining quantity ratio. When, for example, the remaining quantity value D is updated, the controller 1 calculates a new remaining quantity ratio. Every time a new remaining quantity ratio is calculated, the controller 1 makes the display panel 31 display the newly calculated remaining quantity ratio.

(Detection During a Printing Job)

Figure 9:
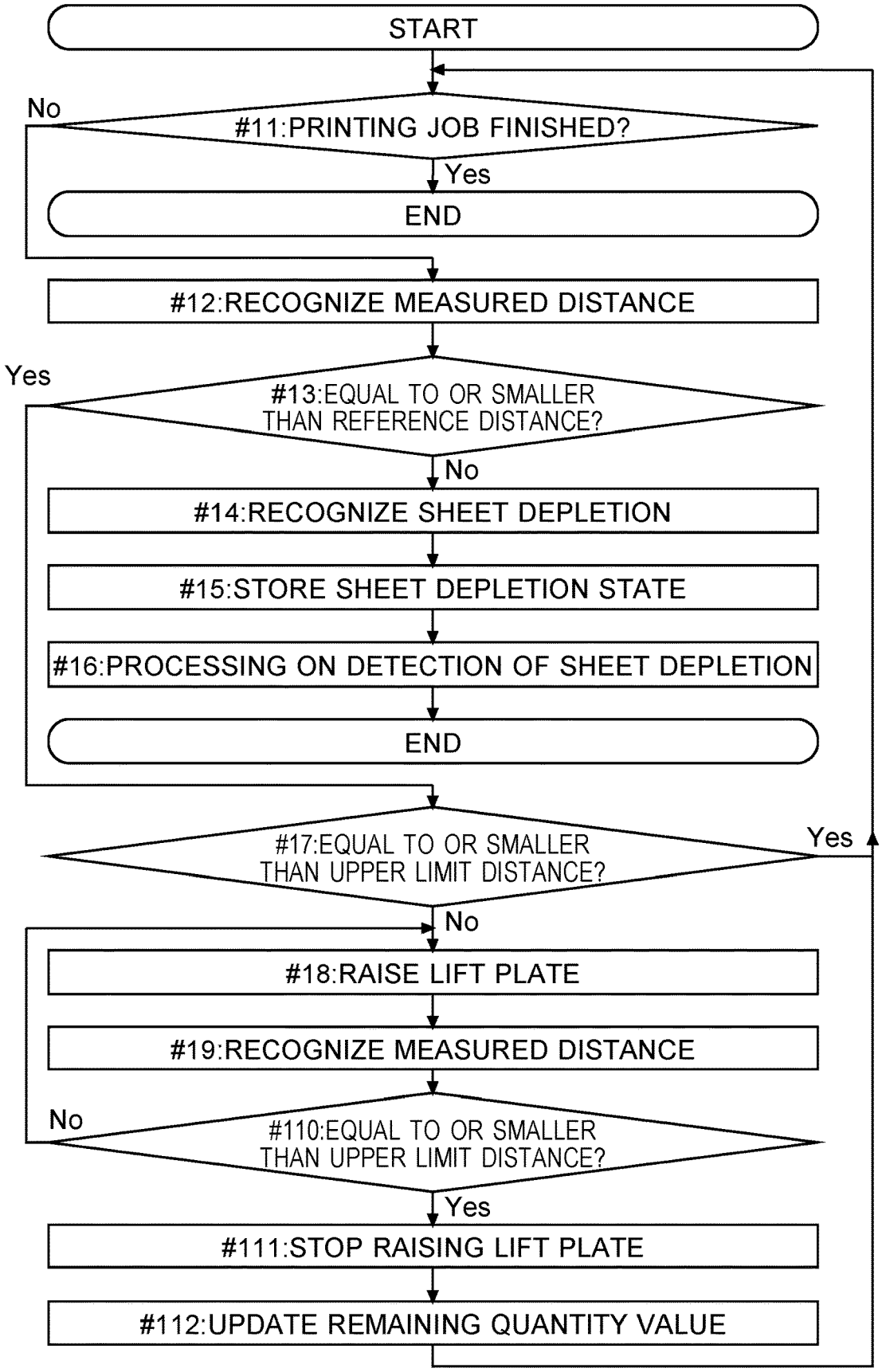
FIG. 9 is a diagram showing one example of detection during a printing job on the printer according to the embodiment.

Next, with reference to FIG. 9, one example of detection during a printing job on the printer 100 according to the embodiment will be described. FIG. 9 is a diagram showing one example of detection during a printing job on the printer 100 according to the embodiment.

"START" in FIG. 9 is the time point at which a printing job is started. In other words, it is the time point at which sheet feeding is started for a printing job. Before the printing job is started, the controller 1 makes the distance sensor 8 operate. When the measured distance recognized based on the output of the distance sensor 8 does not exceed the reference distance B (when it is recognized that there are sheets), the controller 1 starts the printing job.

The controller 1 checks whether the printing job is finished (step #11). When, for example, the last sheet for the printing job is discharged, the controller 1 recognizes that the printing job is finished. A discharge sensor that senses discharge of a sheet is provided in a conveying path. When the printing job is finished (Yes in step #11), the controller 1 ends the procedure (END).

During the printing job (when the printing job is not finished, No in step #11), the controller 1 makes the distance sensor 8 operate and, based on the output of the distance sensor 8, recognizes the measured distance (step #12). Then, the controller 1 checks whether the measured distance is equal to or smaller than the reference distance B (step #13). This is for checking whether sheets have run out during the printing job.

When the measured distance exceeds the reference distance B (No in step #13), the controller 1 recognizes that sheets have run out (step #14). The controller 1 makes the storage medium 2 store the fact that sheets have run out (step #15). The controller 1 makes the storage medium 2 store data (an out-of-sheets flag D2) indicating that sheets have run out (see FIG. 1).

When it is recognized that sheets have run out, the controller 1 performs processing to be performed on detection of sheet depletion (step #16, then END). For example, the controller 1 makes the printing portion 4 stop the printing job. In this case, the controller 1: makes the sheet feeding roller 61 stop rotating; makes the sheet conveyor 41 stop operating; makes the image former 42 stop toner image formation; and makes the rotary member in the fixer 43 stop rotating. The controller 1 makes the display panel 31 display a message indicating, instead of the remaining quantity ratio, sheet depletion.

When the measured distance is smaller than the reference distance B (Yes in step #13), the controller 1 checks whether the measured distance is equal to or smaller than the upper limit distance A (step #17). When the measured distance is equal to or smaller than the upper limit distance A (Yes in step #17), the sheet feeding roller 61 and the topmost sheet are in contact with each other. There is no need to raise the lift plate 71. In this case, the controller 1 performs step #11 next (returns to step #11).

When the measured distance is larger than the upper limit distance A (No in step #17), the sheet feeding roller 61 and the sheet may not be in contact with each other. The lift plate 71 needs to be raised. Thus, the controller 1 makes the lift mechanism 75 raise the lift plate 71 (step #18). Specifically, the controller 1 rotates the lift motor 76. During a printing job, when the measured distance becomes larger than the upper limit distance A, the controller 1 makes the lift mechanism 75 raise the lift plate 71.

The controller 1 operates the distance sensor 8 and recognizes the measured distance (step #19). The controller 1 checks whether the newly recognized measured distance is equal to or smaller than the upper limit distance A (step #110). When the measured distance still exceeds the upper limit distance A (No in step #110), the controller 1 performs step #18 (returns to step #18). That is, during the printing job, while the lift mechanism 75 raises the lift plate 71, the controller 1 repeats recognition of the distance based on the output of the distance sensor 8.

When the measured distance becomes equal to or smaller than the upper limit distance A (Yes in step #110), the controller 1 makes the lift mechanism 75 stop raising the lift plate 71 (step #111). In this way, during a printing job, the controller 1 makes the lift plate 71 ascend in small steps. Then, the controller 1 updates the remaining quantity value D1 (step #112). After the remaining quantity value D1 is updated, the controller 1 performs step #11 (returns to step #11).

Now, the updating of the remaining quantity value D1 will be described. The controller 1 calculates the raising distance of the lift plate 71. Specifically, the controller 1 calculates the raising distance of the lift plate 71 by subtracting the measured distance as it was when the lift plate 71 was stopped from the measured distance of the lift plate 71 before the lift plate 71 was raised. The raising distance may also be calculated by subtracting the upper limit distance A from the measured distance as it was when it exceeded the upper limit distance A (measured distance recognized in step #12). The controller 1 calculates a new remaining quantity value D1 by subtracting the raising distance from the stored remaining quantity value D1. The controller updates the remaining quantity value D1 by making the storage medium 2 store the newly calculated remaining quantity value D1 instead of the previous remaining quantity value D1.

(Detection while No Printing Job is Performed)

Figure 10:
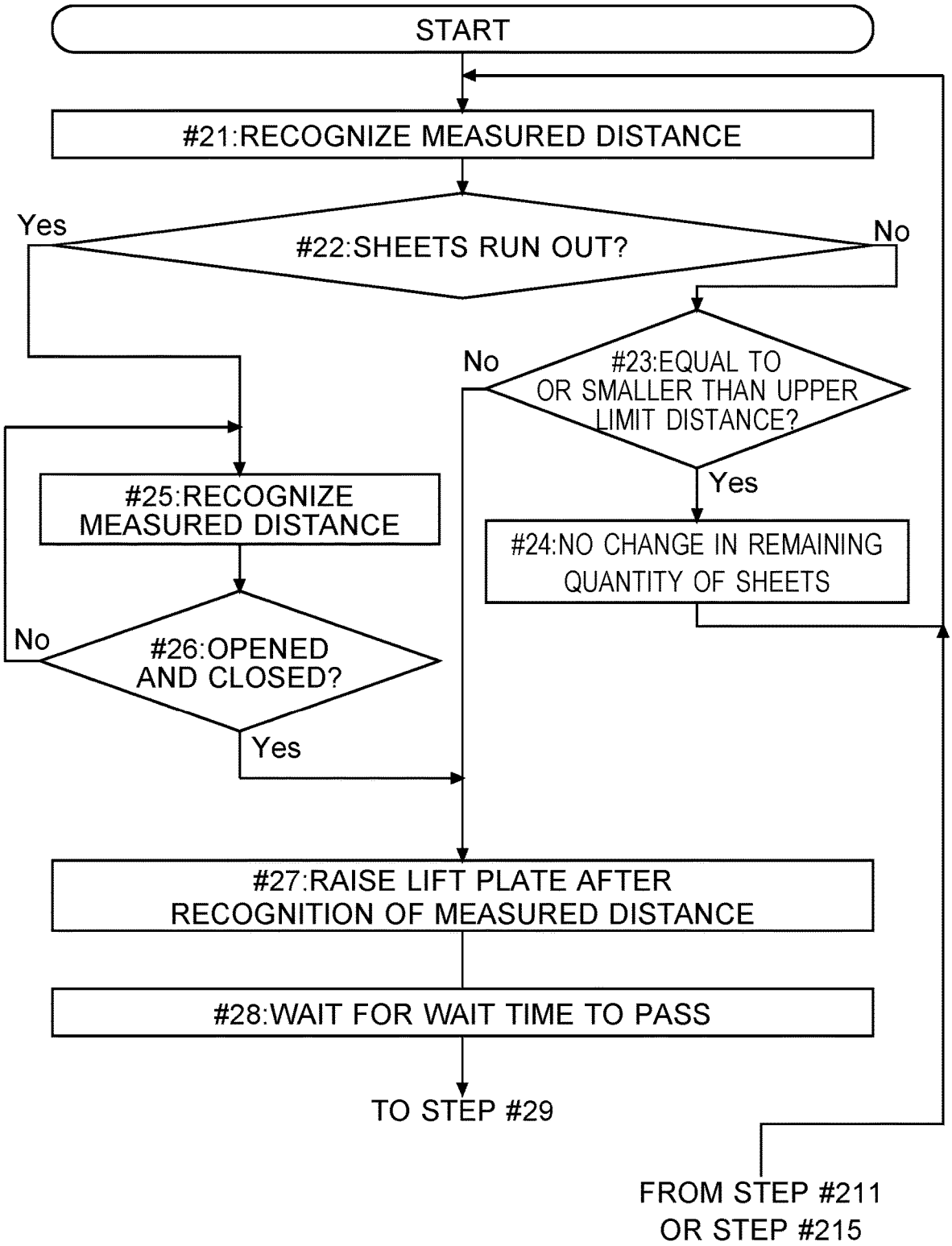
FIG. 10 is a diagram showing one example of detection when the printer according to the embodiment is not performing a printing job.
Figure 11:
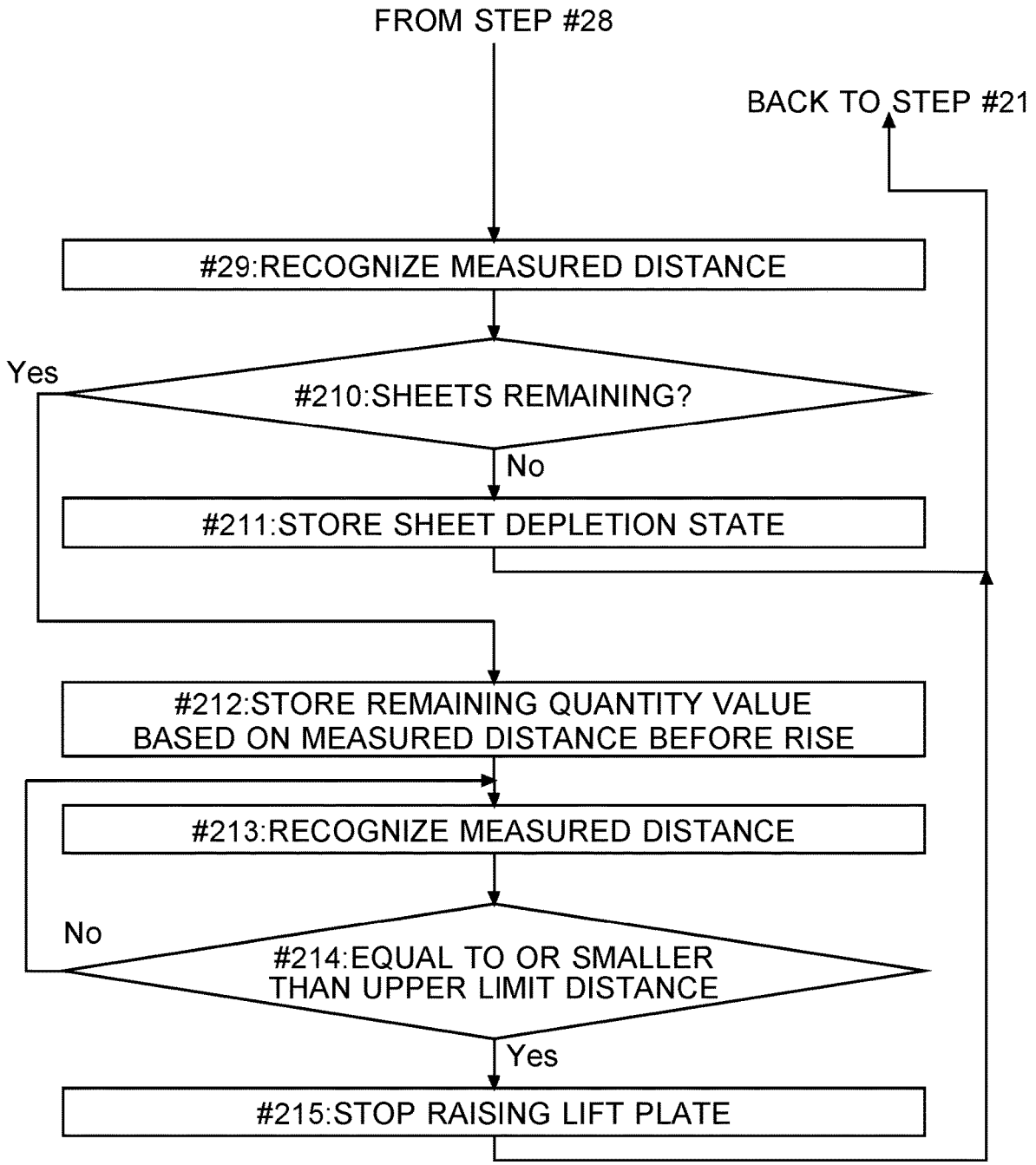
FIG. 11 is a diagram showing the one example of detection when the printer according to the embodiment is not performing a printing job.

Next, with reference to FIGS. 10 and 11, one example of detection while no printing job is performed on the printer 100 according to the embodiment will be described. FIG. 10 is a diagram showing the first half of a sequence of procedure, and FIG. 11 is a diagram showing the latter half of the sequence of procedure.

When no printing job is performed (when no sheets are fed), the controller 1 makes the distance sensor 8 operate at a prescribed cycle. The controller 1 makes the distance sensor 8 repeat emission of a laser beam. Based on the output of the distance sensor 8, the controller 1 recognizes the measured distance periodically. With this, the controller 1 monitors variation of the measured distance. Based on the recognized measured distance, detection is performed.

"START" in FIG. 10 is, for example, the time point at which the power is turned on and the printer 100 is started up. "START" in FIG. 10 is the time point at which a printing job is finished (when the procedure in FIG. 9 ends). At the time point when a printing job is started, the controller 1 ends the procedure in FIGS. 10 and 11.

The controller 1 operates the distance sensor 8 (makes it emit a laser beam) and recognizes the measured distance based on the output of the distance sensor 8 (step #21).

Next, the controller 1 checks whether sheets have run out (step #22). The controller 1 may be configured to check whether sheets have run out by checking the presence or absence of the out-of-sheets flag D2. The controller 1 may be configured to recognize that sheets have run out when the measured distance recognized in step #21 exceeds the reference distance B.

When sheets have not run out (No is step #22), the controller 1 checks whether the measured distance is equal to or smaller than the upper limit distance A (step #23). When the measured distance is equal to or smaller than the upper limit distance A, the controller 1 recognizes that there is no change in the remaining quantity of sheets (step #24). There is no need to raise the lift plate 71. After step #24, the controller 1 performs step #21 (returns to step #21).

When sheets have run out (Yes in step #22), the controller 1 operates the distance sensor 8 (makes it emit a laser beam) and recognizes the new measured distance based on the output of the distance sensor 8 (step #25). Then, the controller 1 checks whether the sheet cassette 7 has been opened and closed (replenished with sheets) (step #26).

When the sheet cassette 7 is removed, the travel distance of the laser beam emitted by the distance sensor 8 goes beyond the bottom plate of the sheet cassette 7. The measured distance recognized by the controller 1 is larger than the reference distance B. When the sheet cassette 7 replenished with sheets is fitted back, the laser beam is reflected on the sheets. As a result, the measured distance recognized by the controller 1 is smaller. As in this case, when the sheet cassette 7 is opened, replenished with sheets, and then closed, the measured distance significantly changes.

The controller 1 may be configured to recognize whether the sheet cassette 7 has been removed and fitted back (the sheet cassette 7 has been opened and closed) based on the amount of change in the measured distance. For example, the controller 1 compares the newly recognized measured distance (measured distance recognized in step #25) with the previously recognized measured distance.

The controller 1 calculates the amount of change by subtracting the newly recognized measured distance from the previously recognized measured distance. When sheets are supplied (the sheet cassette 7 is removed and fitted back), the amount of change is large. Thus, the controller 1 may be configured to recognize that the sheet cassette 7 has been opened and closed when the calculated amount of change is larger than a first threshold value Th1. The controller 1 may be configured to recognize that the sheet cassette 7 has not been opened and closed when the calculated amount of change is equal to or smaller than the first threshold value Th1. The first threshold value Th1 is prescribed. The storage medium 2 stores the first threshold value Th1 in a non-volatile manner (see FIG. 1).

When sheets are supplied, the measured distance is larger than the upper limit distance A but smaller than the reference distance B. Thus, the controller 1 may be configured to recognize that the sheet cassette 7 has been opened and closed (removed and fitted back) when, after the depletion of sheets is recognized (after the out-of-sheets flag D2 data is stored), the measured distance becomes larger than the upper limit distance A but smaller than the reference distance B.

When it is recognized that the sheet cassette 7 has not been opened and closed (No in step #26), the controller 1 performs step #25 (returns to step #25). The controller 1 continues to monitor whether the sheet cassette 7 has been opened and closed. When it is recognized that the sheet cassette 7 has been opened and closed (No in step #26), the controller 1, after operating the distance sensor 8 and recognizing the measured distance (the remaining quantity checking distance C), makes the lift mechanism 75 raise the lift plate 71 (step #27). Specifically, the controller 1 rotates the lift motor 76.

If sheets have not run out, but no printing job has been performed and the measured distance is larger than the upper limit distance (No is step #23), it means that the lift plate 71 has fallen down for some reason. For example, a user may have opened and closed the sheet cassette 7 temporarily. Thus, even when step #23 results in No, the controller 1 makes the lift mechanism 75 raise the lift plate 71 (step #27).

The controller 1, after the lift plate 71 starts to rise, waits for a wait time T1 to pass (step #28). The wait time T1 is prescribed. The storage medium 2 stores the wait time T1 in a non-volatile manner (see FIG. 1). The wait time T1 is specified as necessary. The wait time T1 can be any time period, for example, equal to or longer than several hundred milliseconds but equal to or shorter than one second. When, after the lift plate 71 starts to rise, the wait time T1 has passed, the controller 1 makes the distance sensor 8 operate (emit a laser beam) and recognizes the measured distance (step #29).

The controller 1 checks whether there are sheets set on the lift plate 71 (step #210). The lift plate 71 has a hole 710. If there is no sheet on the lift plate 71, even when the lift plate 71 is raised, the measured distance does not become shorter (does not decrease). In step #29, it is possible to detect sheets being suddenly removed.

Specifically, the controller 1 subtracts the measured distance recognized in step #29 (the measured distance as it was after the lift plate 71 was raised) from the measured distance recognized in step #27 (measured distance as it was immediately before the lift plate 71 was raised; the remaining quantity checking distance C). When the difference determined by the subtraction is larger than a second threshold value Th2, the controller 1 recognizes that there are sheets on the lift plate 71. When the difference is equal to or smaller than the second threshold value Th2, the controller 1 recognizes that there are no sheets on the lift plate 71. The storage medium 2 stores the second threshold value Th2 in a non-volatile manner (see FIG. 1). The second threshold value Th2 is prescribed based on the raising distance of the lift plate 71 during the wait time T1.

When it is recognized that there are no sheets (No in step #210), the controller 1 makes the storage medium 2 store the fact that sheets have run out (step #211). The controller 1 makes the storage medium 2 store data (the out-of-sheets flag D2) indicating that sheets have run out (see FIG. 1). Then, the controller 1 performs step #21 next (returns to step #21).

On the other hand, when it is recognized that there are sheets (Yes in step #210), the controller 1 makes the storage medium 2 store the remaining quantity value D1 based on the measured distance before the lift plate 71 was raised (the measured distance determined in step #27) (step #212). The measured distance at it was before the lift plate 71 was raised indicates the height of the topmost sheet when the lift plate 71 is at the lower limit position. The controller 1, based on formula (1) mentioned above and the measured distance before the lift plate 71 was raised (the remaining quantity checking distance C), newly calculates the remaining quantity value D1. The controller 1 has the newly calculated remaining quantity value D1 stored. In other words, the controller 1 updates the remaining quantity value D1.

The controller 1 may be configured to calculate the remaining quantity ratio based on the new remaining quantity value D1 when the remaining quantity value D1 is updated. The controller 1 may be configured to make the display panel 31 display the calculated remaining quantity ratio. It is possible to display the remaining quantity ratio on the display panel 31 before the lift plate 71 is raised up to the upper limit.

The controller 1 operates the distance sensor 8 and recognizes the measured distance (step #213). The controller 1 checks whether the newly recognized measured distance is equal to or smaller than the upper limit distance A (step #214). When the measured distance still exceeds the upper limit distance A (No in step #214), the controller 1 performs step #213 (returns to step #213). That is, after the sheet cassette 7 is opened and closed, while the lift mechanism 75 raises the lift plate 71, the controller 1 repeats recognition of the distance based on the output of the distance sensor 8.

When the measured distance becomes equal to or smaller than the upper limit distance A (Yes in step #214), the controller 1 makes the lift mechanism 75 stop raising the lift plate 71 (step #215). After the lift plate 71 is stopped, the controller 1 performs step #21 (returns to step #21).

As described above, the sheet feeding device (printer 100) according to the embodiment includes the sheet cassette 7, the lift plate 71, the lift mechanism 75, the sheet feeding roller 61, the distance sensor 8, and the controller 1. The lift plate 71 is provided inside the sheet cassette 7. Sheets are set on the top face of the lift plate 71. The lift mechanism 75 makes the lift plate 71 ascend and descend. The sheet feeding roller 61 is provided over the lift plate 71. The sheet feeding roller 61 makes contact with sheets lifted up by the lift mechanism 75. The sheet feeding roller 61 rotates and feeds out sheets. The distance sensor 8 is provided over the lift plate 71. The distance sensor 8 measures the measured distance, that is, the distance to the measurement target placed below. Based on the output of the distance sensor 8, the controller 1 recognizes the measured distance. After the sheet cassette 7 is opened and closed, based on the measured distance recognized before the lift plate 71 is raised, the controller 1 calculates the remaining quantity value D1 indicating the remaining quantity of sheets. When, after the lift plate 71 starts to rise, the recognized measured distance becomes equal to or smaller than the upper limit distance prescribed as the measured distance as it is when the lift plate 71 is at the upper limit position, the controller 1 makes the lift mechanism 75 stop raising the lift plate 71.

It is possible to sense, based on the output of the distance sensor 8, the remaining quantity of sheets and to detect whether the lift plate 71 has reached the upper limit. The distance sensor 8 can be used as a remaining sheet quantity sensor as well as an upper limit detection sensor. It is possible to detect a plurality of items with a single sensor. It is possible to reduce the number of sensors to be installed. It is possible to reduce the manufacturing cost of the sheet feeding device. It is possible to simplify the manufacturing steps of the sheet feeding device.

The lift plate 71 has a hole 710 formed in the detection range of the distance sensor 8. When the recognized measured distance exceeds the reference distance B prescribed based on the distance from the distance sensor 8 to the lift plate 71 at the lower limit position, the controller 1 recognizes that sheets have run out. It is possible to detect that sheets have run out (sheet depletion) in the sheet cassette 7 correctly using the distance sensor 8. With sensors dedicated to detecting the remaining quantity, it is difficult to correctly distinguish the case where the remaining quantity is small from the case where sheets have run out. Thus, a sensor dedicated to detecting sheet depletion is provided. With the sheet feeding device of the present disclosure, it is possible to accurately detect, with a single sensor, how large the remaining quantity is, whether the upper limit has been reached, and whether sheets have run out. It is possible to reduce the number of sensors to be installed. It is possible to reduce the manufacturing cost of the sheet feeding device. It is possible to simplify the manufacturing steps of the sheet feeding device.

The lift mechanism 75 maintains the height of the lift plate 71 until the sheet cassette 7 is opened. The controller 1 periodically recognizes the measured distance based on the output of the distance sensor 8. When, after the lift plate 71 is raised, the recognized measured distance is equal to or smaller than the upper limit distance A, the controller 1 recognizes that there is no change in the remaining quantity of sheets. It is possible to sense that there is no change in the remaining quantity of sheets based on the output of the distance sensor 8.

When sheets have run out, the controller 1 calculates the amount of change in the measured distance. The controller 1 may be configured to recognize that the sheet cassette 7 has been opened and closed when the calculated amount of change is larger than a first threshold value Th1. The controller 1 may be configured to recognize that the sheet cassette 7 has been opened and closed when, after sheets have run out, the measured distance becomes larger than the upper limit distance A but smaller than the reference distance B. It is possible to detect that the sheet cassette 7 has been opened and closed (replenished with sheets) using the distance sensor 8. Conventionally, there is provided a sensor dedicated to detecting the cassette being opened and closed. According to the sheet feeding device of the present disclosure, it is possible to accurately detect, with a single sensor, whether the sheet cassette 7 has been opened and closed, how large the remaining quantity is, whether the upper limit has been reached, and whether sheets have run out. It is possible to reduce the number of sensors to be installed. It is possible to reduce the manufacturing cost of the sheet feeding device. It is possible to simplify the manufacturing steps of the sheet feeding device.

When it is recognized that sheet cassette 7 has been opened and closed, the controller 1 makes the lift mechanism 75 start raising the lift plate 71. It is possible to start the rise of the lift plate 71 automatically when the sheet cassette 7 is opened or closed. After the sheet cassette 7 is closed, sheets and the sheet feeding roller 61 make contact with each other immediately. It is possible to promptly complete the preparation of sheet feeding.

The controller 1 calculates the difference by subtracting the measured distance recognized when the prescribed wait time T1 has passed after the lift plate 71 starts to rise from the measured distance before the lift plate 71 started to rise. When the calculated difference is larger than the prescribed second threshold value Th2, the controller 1 makes the storage medium 2 store the remaining quantity value D1 based on the measured distance before the lift plate 71 started to rise. With the calculated difference, it is possible to recognize whether sheets are set on the lift plate 71. Before the rise of the lift plate 71 is complete, it is possible to calculate the remaining quantity value D1 and to determine the remaining quantity.

During a printing job, when the measured distance becomes larger than the upper limit distance A, the controller 1 makes the lift mechanism 75 raise the lift plate 71. While the lift mechanism 75 raises the lift plate 71, the controller 1 repeats recognition of the measured distance based on the output of the distance sensor 8. When the recognized measured distance becomes equal to or smaller than the upper limit distance A, the controller 1 makes the lift mechanism 75 stop raising the lift plate 71. The controller 1 calculates the raising distance by subtracting the measured distance as it was when the lift plate 71 was stopped from the measured distance before the lift plate 71 was raised. A new remaining quantity value D1 is calculated by subtracting the raising distance from the remaining quantity value D1. The controller 1 makes the storage medium 2 store the calculated new remaining quantity value D1. Even when sheets are consumed in a printing job, it is possible to keep the sheet feeding roller 61 and sheets in contact with each other. Based on the distance corresponding to the thickness of the consumed sheets, it is possible to update the remaining quantity value D1.

The description given above of embodiments of the present disclosure is in no way meant to limit the scope of the present disclosure; the present disclosure can be implemented with any modifications made without departing from the spirit of the present disclosure. For example, the sheet feeding device described above can be understood as an invention of a method for controlling a sheet feeding device.

The present disclosure is applicable to sheet feeding devices (image forming apparatus) provided with a lift plate and a lift mechanism which raises and lowers the lift mechanism.

What is claimed is:

1. A sheet feeding device, comprising:

a sheet cassette;

a lift plate which is provided inside the sheet cassette and on top of which sheets are set;

a lift mechanism which makes the lift plate ascend and descend;

a sheet feeding roller which is provided over the lift plate, the sheet feeding roller making contact with sheets lifted up by the lift mechanism and feeding out sheets by rotating;

a distance sensor which is provided over the lift plate and which measures a measured distance, which is a distance to a measurement target placed below; and a controller, wherein the controller recognizes the measured distance based on an output of the distance sensor, after the sheet cassette is opened and closed, calculates a remaining quantity value indicating a remaining quantity of sheets based on the measured distance recognized before the lift plate is raised, and when, after the lift plate starts to rise, the recognized measured distance becomes equal to or smaller than an upper limit distance prescribed as the measured distance when the lift plate is at an upper limit position, makes the lift mechanism stop raising the lift plate.

2. The sheet feeding device according to claim 1, wherein the lift plate has a hole formed in a detection range of the distance sensor, and when the recognized measured distance exceeds a reference distance prescribed based on the distance from the distance sensor to the lift plate at the lower limit position, the controller recognizes that sheets have run out.

3. The sheet feeding device according to claim 2, wherein the controller recognizes that the sheet cassette has been opened and closed when, after sheets have run out, the measured distance becomes larger than the upper limit distance but smaller than the reference distance.

4. The sheet feeding device according to claim 3, wherein on recognizing that the sheet cassette has been opened and closed, the controller makes the lift mechanism start raising the lift plate.

5. The sheet feeding device according to claim 3, wherein the controller calculates the difference by subtracting the measured distance recognized when a prescribed wait time has passed after the lift plate starts to rise from the measured distance before the lift plate started to rise, and when the calculated difference is larger than a prescribed second threshold value, makes the storage medium store the remaining quantity value based on the measured distance before the lift plate started to rise.

6. The sheet feeding device according to claim 3, wherein during a printing job, the controller when the measured distance becomes larger than the upper limit distance makes the lift mechanism raise the lift plate, while the lift mechanism raises the lift plate, repeats recognition of the measured distance based on the output of the distance sensor, when the recognized measured distance becomes equal to or smaller than the upper limit distance, makes the lift mechanism stop raising the lift plate, calculates the raising distance by subtracting the measured distance when the lift plate was stopped from the measured distance before the lift plate was raised, calculates a new remaining quantity value by subtracting the raising distance from the remaining quantity value, and makes the storage medium store the calculated new remaining quantity value.

7. The sheet feeding device according to claim 1, wherein the lift mechanism maintains a height of the lift plate until the sheet cassette is opened, and the controller periodically recognizes the measured distance based on the output of the distance sensor, and when, after the lift plate is raised, the recognized measured distance is equal to or smaller than the upper limit distance, recognizes that there is no change in the remaining quantity of sheets.

8. The sheet feeding device according to claim 1, wherein the controller calculates an amount of change in the measured distance when sheets have run out, and recognizes that the sheet cassette has been opened and closed when the calculated amount of change is larger than a first threshold value.

9. The sheet feeding device according to claim 8, wherein on recognizing that the sheet cassette has been opened and closed, the controller makes the lift mechanism start raising the lift plate.

10. The sheet feeding device according to claim 8, wherein the controller calculates a difference by subtracting the measured distance recognized when a prescribed wait time has passed after the lift plate starts to rise from the measured distance before the lift plate started to rise, and when the calculated difference is larger than a prescribed second threshold value, makes the storage medium store the remaining quantity value based on the measured distance before the lift plate started to rise.

11. The sheet feeding device according to claim 8, wherein during a printing job, the controller when the measured distance becomes larger than the upper limit distance, makes the lift mechanism raise the lift plate, while the lift mechanism raises the lift plate, repeats recognition of the measured distance based on the output of the distance sensor, when the recognized measured distance becomes equal to or smaller than the upper limit distance, makes the lift mechanism stop raising the lift plate, calculates the raising distance by subtracting the measured distance when the lift plate was stopped from the measured distance before the lift plate was raised, calculates a new remaining quantity value by subtracting the raising distance from the remaining quantity value, and makes the storage medium store the calculated new remaining quantity value.

12. A method for controlling a sheet feeding device, the method comprising:

providing a lift plate inside a sheet cassette;

setting sheets on the top face of the lift plate;

raising and lowering the lift plate;

arranging a sheet feeding roller over the lift plate;

feeding out sheets by bringing the sheet feeding roller into contact with sheets lifted up by raising and rotating the sheet feeding roller;

arranging a distance sensor over the lift plate;

measuring, using the distance sensor, a measured distance, which is a distance to a measurement target below;

recognizing the measured distance based on an output of the distance sensor;

after the sheet cassette is opened and closed, calculating a remaining quantity value indicating a remaining quantity of sheets based on the measured distance recognized before the lift plate is raised; and when, after the lift plate starts to rise, the recognized measured distance becomes equal to or smaller than an upper limit distance prescribed as the measured distance when the lift plate is at an upper limit position, making the lift mechanism stop raising the lift plate.

13. A sheet feeding device, comprising:

a sheet cassette;

a lift motor;

a shaft;

a joint member;

a lift plate which is provided inside the sheet cassette and on top of which sheets are set, the lift plate rising as the shaft rotates;

a sheet feeding roller which is provided over the lift plate, the sheet feeding roller making contact with sheets lifted up by the lift plate and feeding out sheets by rotating;

a distance sensor which is provided over the lift plate and which measures a measured distance, which is a distance to a measurement target placed below; and a controller, wherein in a state where the sheet cassette is fitted, the shaft is coupled to the lift motor via the joint member to rotate by being driven by the lift motor, in a state where the sheet cassette is pulled out, the joint member and the shaft decouple from each other and the lift plate descends under gravity, the controller recognizes the measured distance based on an output of the distance sensor, after the sheet cassette is opened and closed, calculates a remaining quantity value indicating a remaining quantity of sheets based on the measured distance recognized before the lift plate is raised, and when, after the lift plate starts to rise, the recognized measured distance becomes equal to or smaller than an upper limit distance prescribed as the measured distance when the lift plate is at an upper limit position, stops the lift motor to stop a rise of the lift plate.

* * * * *